United States Patent [19]

Martin

[11] Patent Number: 4,837,410

[45] Date of Patent: Jun. 6, 1989

[54] SWITCH

[75] Inventor: Manuel F. Martin, Valls, Spain

[73] Assignee: Mecanismos Auxiliares Industriales, SA -M.A.I.S.A., Valls, Spain

[21] Appl. No.: 214,843

[22] Filed: Jun. 22, 1988

Related U.S. Application Data

[63] Continuation of Ser. No. 1,861, Jan. 9, 1987, abandoned.

[30] Foreign Application Priority Data

Mar. 24, 1986 [ES] Spain ..... 293339

[51] Int. Cl.[4] ..... H01H 9/00; H01H 13/56

[52] U.S. Cl. ..... 200/5 R; 200/314; 200/526; 200/341

[58] Field of Search ..... 200/5 R, 153 J, 156, 200/159 R, 314

[56] References Cited

U.S. PATENT DOCUMENTS

| | | | |
|---|---|---|---|
| 2,950,372 | 8/1960 | Aspinwall | 200/156 |
| 3,542,988 | 11/1970 | Baldasare | 200/153 J X |
| 4,431,879 | 2/1984 | Fujita et al. | 200/314 |
| 4,506,124 | 3/1985 | Rose et al. | 200/153 J |

*Primary Examiner*—J. R. Scott

*Attorney, Agent, or Firm*—Holman & Stern, Chartered

[57] ABSTRACT

A push-button switch operates by depression of a push-button to move a movable contact into engagement with respective fixed contacts. The push-button when depressed rotates a roller through a predetermined angle by means of interengaging ratchet-type teeth on the push-button and roller respectively. A two-arm lever engages an indented outer surface of the roller, so that forward or reverse pivotal movements of the lever are effected whenever the push-button is depressed. The lever operates the movable contact. The roller also carries a segmented colored disc so that alternating colors are associated with the push-button to represent the respective movable contact positions.

4 Claims, 2 Drawing Sheets

SWITCH

This is a continuation of application Ser. No. 001,861, filed Jan. 9, 1987 now abandoned.

BACKGROUND OF THE INVENTION

The present utility model consists, as indicated in title thereof, of a "PUSHBUTTON SWITCH" invention provides a switch, the new constructive, shape and design features of which fulfill the mission for which it has been specifically devised with maximum security and efficacy.

This switch has been especially designed for application preferably in the automobile industry.

As is known, it is becoming more frequent for the switches used in automobiles to be illuminated with a particular colour when they are in the off position and the colour of the push-button changes when they have been activated, which is highly appreciated by the user, since in this way it is relatively easy to realise what is the situation of the corresponding switch.

This switch is constituted basically by a casing to which there has been adapted a push-button which bears on the top thereof the symbol corresponding to the function of the switch.

In turn, this switch is provided in the central portion thereof with a roller which is fixedly attached at the upper end portion thereof to a disc which is divided into sectors and which when actuated upon by the push-button causes the roller to rotate in the same direction by a predetermined angle.

The disc located at the top portion of the roller is provided with two different colours alternately, the configuration thereof coinciding with windows in the push-button in the form of sectors with the same angle at which the colours of the disc have been prepared, whereby said windows being alternately disposed, avoid the mixing of colours, with the result that, in one position of the switch, a single colour on the disc corresponds perfectly with the windows, whereby the symbol on the top wall of the push-button will be illuminated due to the light transmitted from a bulb located in the central portion of the roller. When the push-button is depressed once again, the roller will be caused to rotate and therewith the disc, whereby the other colour applied to the said disc will be made to coincide, thereby producing a change of colour of the symbol.

In the lower side portion of the roller are provided notches spaced apart at twice the angle of turn of the roller, whereby every time the switch is operated the end of a crank lever engages with the side surface of the roller or the next time, the interior of the notch and this difference of position will be converted to pivotal movement of the lever about its axis of turn.

At the free end of the lever there is housed the end of a rocker arm which forms the moving switch contact, this rocker arm being positioned and held to the lever by a spring which ensures in turn that the opposite end of the lever is pressed constantly against the roller.

Obviously with the rotation of the roller, the end of the lever, on being moved, breaks the point of balance of the spring whereby there is obtained a sharp movement of the moving contact, the latter being moved until it bears against the corresponding fixed contact, remaining in this position until the push-button is operated again, at which time this moving contact would return through the centre of balance of the spring and would return to its initial position, bearing against the other fixed contact.

In turn, due to the configuration of the lever, before breaking the point of balance of the spring, it allows the moving contact to move over its respective fixed contact, causing the tip of the moving contact to wipe before it snaps from one fixed contact to the other, thereby obtaining self cleaning of the contact area.

Other details and features of this invention will become obvious from the following description, wherein references made to the drawings accompanying this specification in which, somewhat schematically, there are shown the preferred details. These details are given as an example, with the reference to one possible embodiment, but it is not limited to the details given herein; therefore this description should be considered from an illustrative point of view without limitations of any type.

BRIEF DESCRIPTION OF THE DRAWINGS

FIG. 6 is a side elevation view in cross section of the switch housing.

DESCRIPTION OF PREFERRED EMBODIMENT

Figure 1:
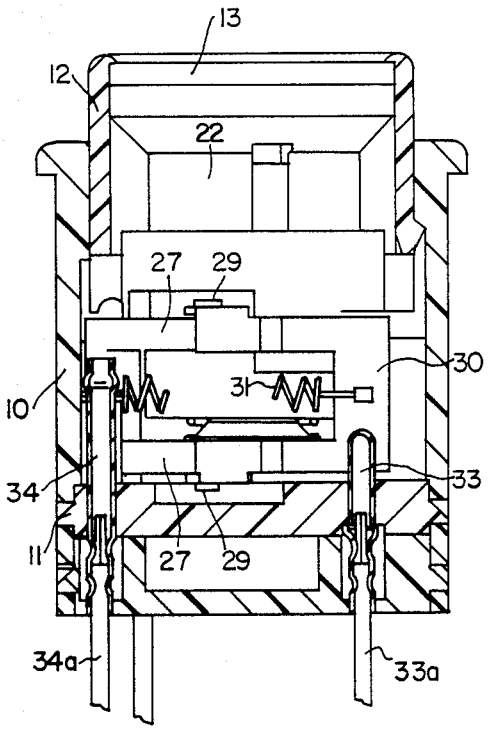
FIG. 1 is a front elevation view in cross section of the switch according to this invention.
Figure 2:
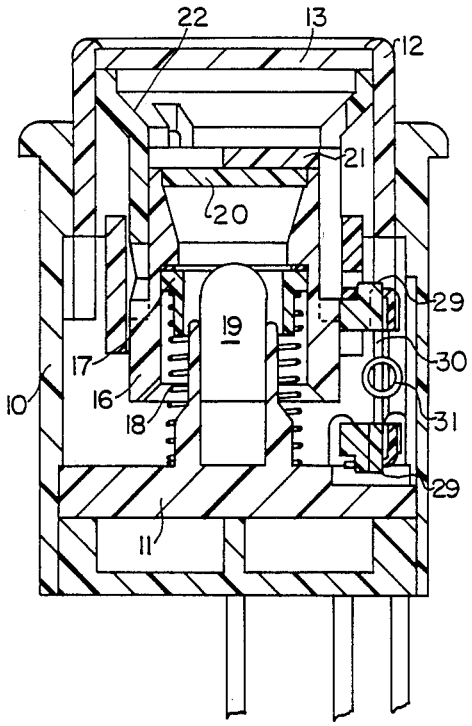
FIG. 2 is a side elevation view in cross section of the switch wherein the different component elements may be observed.
Figure 3:
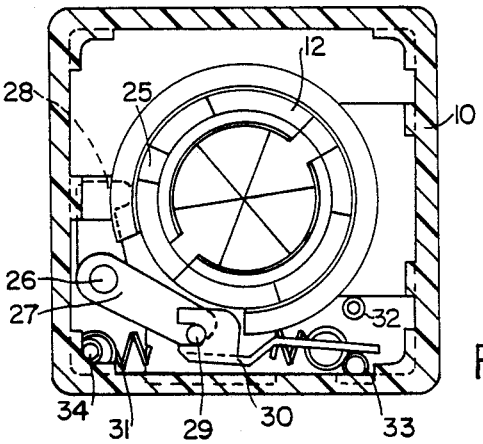
FIG. 3 is a plan view in cross section wherein the operation of the moving contact may be seen.
Figure 4:
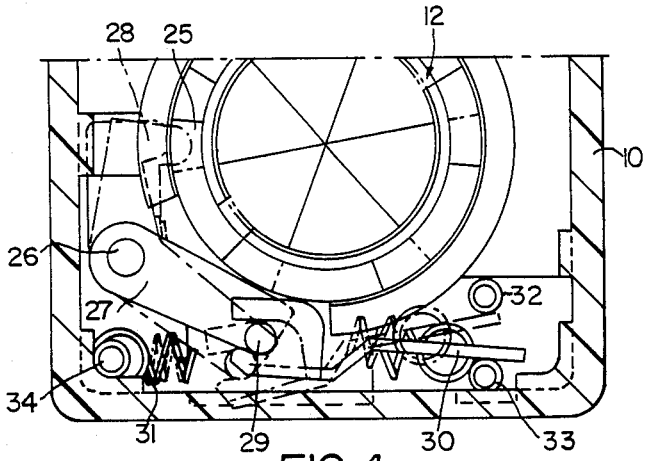
FIG. 4 is a detail of the switch in plan view wherein there may be seen the various positions which the moving contact may adopt.

In the accompanying figures it may be seen that this switch is formed by a generally prismatic hollow casing (10) at the lower portion whereof there is a base plate (11) on which various contacts are mounted.

The casing receives a push-button (12), on the top wall (13) on which there is a symbol corresponding to the function that this switch has to perform.

In turn, this push-button is provided with a driving drum (22) which will act on the sloping surfaces (15) of a follower roller (16). The roller is located in the central portion of the switch in a floating position due to the fact that in the interior thereof it has been fitted with a washer (17), against which there bears a spring (18), the lower end of which bears against the base plate (11), which in turn supports a conventional bulb (19) located in the central portion of the roller (16).

To the top wall of the roller (16) there is fixedly attached a disc (20) which is divided in segments having an angle identical to the angle of rotation of the roller (16) which will rotate as a result of the push-button (12) being depressed, the segments of this disc (20) being made of a translucid material and provided with two different alternate colours.

In a bore of the disc (20) there are installed fixed windows (21) made in form of sectors with the same angle which with the colours have been provided on the disc (20) and since the distance between the windows (21) and the disc (20) is minimal, in one position of the switch the symbol (13) on the push-button (12) will be seen in one colour, whereas in the other position it will be seen in the other colour of the disc (20).

Figure 5:
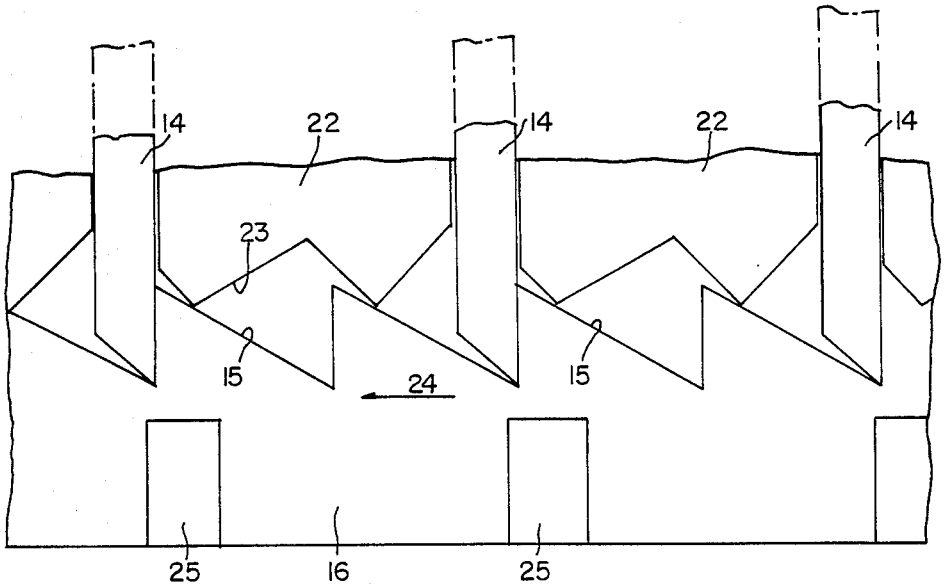
FIG. 5 is a development view of a part of the roller in which there is seen how the latter is moved when the push-button is depressed.

The rotary movement of the roller (16) is attained—see FIG. 5—thanks to the fact that the roller (16) is provided on the side wall thereof with a number of sloping surfaces (15) in saw tooth fashion, which sloping surfaces (15) are engaged by retaining fingers (14) fixed in the casing and each of which terminate with a sloping surface slightly sharper than surfaces (15), there being in turn, integral with the push-button a drum (22), which is provided in turn with a further number of sloping surfaces (23).

When the push-button (12) is initially depressed, since the retaining fingers (14) are situated in the lowermost portion of the sloping surfaces (15), the rotary movement of the roller (16) is prevented. Then, as result of the apexes of the sloping surfaces (23) of the drum (22) forming part of the push-button (12) being engaged, with teeth 15 vertical downward movement of the roller (16) takes place, until the upper apexes of the sloping surfaces (15) of the roller (16) move past the retaining fingers (14) at which time the roller (16) will rotate in the direction of the arrow (24), this rotation being limited precisely to the length of the surfaces 15 because the retaining fingers (14) will be relocated in the lower end of the sloping surface (15) when the push-button (12) is released, whereby logically as the push-button is depressed again and again, the movement of roller (16) will be repeated, whereby the change of colour of the symbol of the push-button is obtained.

The lowermost portion of the roller (16) is provided on its side wall thereof with notches (25) having a diameter smaller than that of the side wall of the roller (16) which notches are spaced apart with an angle of twice the angle of rotation of the roller (16), whereby when the push-button (12) is depressed and consequently when the roller (16) rotates, the notches (25) will have the same displacement as the roller.

In turn, on the base plate (11) there is installed the pin (26) to which there is fixedly mounted a two-arm lever (27) which terminates at one end in a protrusion (28) permanently in contact with the roller (16), whereby with the movement of the roller (16) the protrusion (28) will be situated in the notch (25) or against the side wall of the roller, consequently causing the lever (27) to pivot around the pin (26).

To the opposite end of the lever (27) there is attached a pin (29) which is located in an aperture in the moving contact (30), and which is positively located since it is permanently pushed by the spring (31) which is attached to a terminal (34) is the housing at one end thereof, while the other end thereof is connected to the moving contact (30). Spring (31) may serve to conduct electricity between terminal (34) and contact (30).

When lever (27) pivots, in the first place there will be a longitudinal displacement of the moving contact (30) whereby it is caused to wipe against the respectively one of the fixed contacts (33) or (32) with which it is engaged so that thereafter as the lever (27) rotates, the line of balance of the spring (31) will break, causing sharp displacement of the moving contact (30) to snap against the other fixed contact (32) or (33).

When the push-button (12) is depressed once again, by the rotary movement of the roller (16) the lever (27) will move again in the opposite direction, causing the moving contact (30) to return to the other position thereof.

The design of this switch allows the installation of another lever (27) and moving contact (30) set in an opposite position, whereby the functions may be duplicated, the switch being usable for a wide range of applications.

I claim:

1. A pushbutton switch comprising a casing having a base wall, a peripheral wall extending upwardly from the base wall and an open top, a depressable pushbutton received in the casing and extending from the open top, finger elements fixed in the casing defining means for guiding the pushbutton to perform up and down movements in the casing when the pushbutton is depressed and released, a rotatable follower roller rotatably supported in the casing for depression and rotation below the pushbutton, interengagable teeth on the pushbutton and roller respectively, the teeth and finger elements together defining means for translating repetitive up and down movements of the pushbutton into incremental equal-angle rotational movements of the roller, a pair of fixed switch contacts mounted on the base wall, a moveable contact mounted in the casing for back and forth movement between respective engagement positions contacting the respective fixed contacts selectively, an actuating lever mounted on the base wall and connected with the moveable contact for moving the moveable contact back and forth between said engagement positions by respective forward and reverse pivotal movements of the lever, the roller having a repetitively indented peripheral wall engaging said lever for providing the respective forward and reverse pivotal movements of the lever with respective alternate incremental movements of the roller whereby the moveable contact is moved between the respective engagement positions each time the pushbutton is depressed.

2. A switch as defined in claim 1, including a pivot connection between the lever and the movable contact and a spring connected between the movable contact and an attachment in the casing, the lever, the movable contact, and the spring being mutually interconnected and configured for providing translatory wiping movement of the movable contact over the respective fixed contact prior to movement of the movable contact between the fixed contacts responsive to said forward and reverse movements of the lever.

3. A switch as defined in claim 1, including a disc with alternating angularly related colors on the roller and window means between the disc and the push-button for viewing the colors alternatively through the push-button with respectively incremental movements of the roller.

4. A switch as defined in claim 3, including illumination means internally of the roller for illuminating the push-button.

* * * * *